United States Patent [19]

Forte

[11] Patent Number: 4,565,775

[45] Date of Patent: Jan. 21, 1986

[54] PROCESS FOR THE PRODUCTION OF PHOTOGRAPHIC IMAGES BY THE SILVER DYE BLEACH PROCESS

[75] Inventor: Eddy Forte, Pully, Switzerland

[73] Assignee: Ciba-Geigy AG, Basel, Switzerland

[21] Appl. No.: 689,755

[22] Filed: Jan. 9, 1985

[30] Foreign Application Priority Data

Jan. 20, 1984 [CH] Switzerland ..... 250/84
Oct. 8, 1984 [CH] Switzerland ..... 4813/84

[51] Int. Cl.[4] ..... G03C 7/32

[52] U.S. Cl. ..... 430/390; 430/392; 430/393; 430/431; 430/462

[58] Field of Search ..... 430/390, 392, 393, 431, 430/17, 462

[56] References Cited

U.S. PATENT DOCUMENTS 4,197,123 4/1980 Oetiker et al. ..... 430/431
4,266,011 5/1981 Jan ..... 430/392
4,304,846 12/1981 Marthaler et al. ..... 430/393
4,366,232 12/1982 Buser et al. ..... 430/431
4,391,884 7/1983 Meyer et al. ..... 430/392
4,404,273 9/1983 Forte et al. ..... 430/393

*Primary Examiner*—J. Travis Brown
*Attorney, Agent, or Firm*—Joseph G. Kolodny

[57] ABSTRACT

In a process for the production of photographic images by the silver dye bleach process, a photograph material is used which, on a base, comprises at least one silver halide-free gelatin layer, which contains a diffusion-resistant bleachable image dye, the gelatin/dye ratio being at most 10:1, and a silver halide emulsion layer which is arranged directly on top of the former layer on the side facing the light source and is free of image dye, and the exposed material is processed in a dye and silver bleach bath which contains a combination of oxidizing agents of the formula (1a) with bleach catalysts of the formulae (2a) and (3), or of the oxidizing agent of the formula (1b) with bleach catalysts of the formula (2b).

9 Claims, No Drawings

PROCESS FOR THE PRODUCTION OF PHOTOGRAPHIC IMAGES BY THE SILVER DYE BLEACH PROCESS

The present invention relates to a process for the production of photographic images by the silver dye bleach process.

Photographic images produced by the silver dye bleach process are obtained by exposure and processing of the photographic material which contains at least one silver halide emulsion layer with a bleachable image dye. After the material exposed imagewise has been developed, the image dye is bleached in the areas of the silver image, whereby a positive dye image is formed. The silver dye bleach process is described in detail in Photographic Science and Engineering, volume 18, pages 530 to 534.

It has hitherto not been possible to produce silver dye bleach materials which are sufficiently fast for taking photographs. This is to be ascribed mainly to the optical desensitisation by the image dyes which are contained in the unexposed silver dye bleach material and absorb in the same spectral region as the corresponding silver halide emulsions.

British Patent Specification No. 421,727 has disclosed that the image dye and silver halide can also be used in separate, mutually adjacent layers. Accordingly, the said disadvantage of the desensitisation by the image dyes can be partially overcome, for example, by arranging the silver halide emulsion layer on that side of the layer containing the image dye which faces the light source. Bleaching of this dye by the silver image developed in the adjacent layer ("distant bleaching") is effected by the processing of the exposed and developed material in bleach baths containing a quinoxaline or phenazine, as proposed, for example, in British Patent Specification No. 514,955.

Photographic images with white image areas, however, cannot be produced by this process without the presence of a large silver excess in the developed material. However, this silver excess causes an unduly steep colour gradation and also leads to the undesired bleaching of image dye in those layers of a multi-layer material which are allocated to another silver halide emulsion layer, even if these are separated by gelatin interlayers from the layer containing the silver excess. On the other hand, however, a silver excess is necessary in order to provide the material with a sufficiently high speed.

Thus, usable silver dye bleach material which can be used as camera material under normal exposure conditions was therefore not available.

It has now been found that fast silver dye bleach material which contains separate silver halide and image dye layers, the layers containing the image dye having a gelatin/dye ratio of at most 10:1, can be processed without the above disadvantages if the dye and silver bleach is carried out in the presence of a selected combination of oxidising agents and bleach catalysts.

The present invention thus relates to a process for the production of photographic images by the silver dye bleach process by exposure, development, dye and silver bleach, and fixing of a photographic material which, on a base, contains at least one photographic element comprising a silver halide-free gelatin layer, which contains a diffusion-resistant bleachable image dye, and a silver halide emulsion layer which is arranged directly on top of the former layer on the side facing the light source and is free of image dye, wherein (a) the gelatin layer containing the image dye has a gelatin/dye ratio of at most 10:1, (b) the oxidising agent used in the dye and silver bleach is of the formula

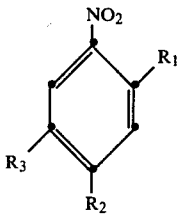

(1)

or

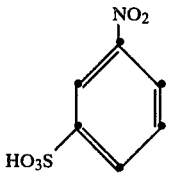

(1b)

in which $R_1$ is hydrogen, alkyl having 1 to 4 carbon atoms, amino or $—SO_3H$, $R_2$ is hydrogen, amino or hydroxyl and $R_3$ is hydrogen, nitro or $—SO_3H$, $R_3$ being other than $—SO_3H$ if $R_1$ and $R_2$ are hydrogen, and (c) the bleach catalyst used in the dye and silver bleach is of the formula

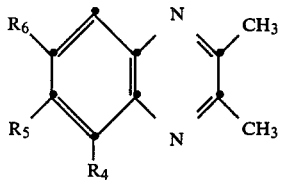

(2a)

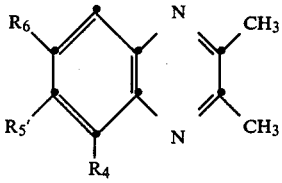

(2b)

or

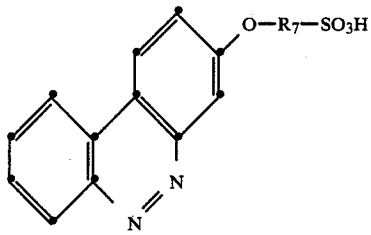

(3)

in which $R_4$ is hydrogen or amino, $R_5$ is hydrogen, hydroxyl, alkyl or alkoxy having 1 to 4 carbon atoms or $—O—R_7—SO_3H$ or $—O—R_7—OH$, $R_5'$ is as defined for $R_5$ with the exception of hydrogen and $—O—R_7—SO_3H$, and $R_5'$ is not methyl or methoxy if $R_4$ and $R_6$ are hydrogen, $R_6$ is hydrogen or alkyl or alkoxy each having 1 to 4 carbon atoms and $R_7$ is alkylene having 1 to 4 carbon atoms, those oxidising agents in which $R_2$ is hydroxyl being used only in conjunction with at least tetrasubstituted quinoxalines, those oxidising agents in which $R_2$ is amino being used only in conjunction with at most trisubstituted quinoxalines, and the oxidising agent of the formula (1b) being used only with bleach catalysts of the formula (2b).

In a further embodiment, the present invention also relates to a process for the production of photographic images by the silver dye bleach process by exposure, development, dye and silver bleach, and fixing of a photographic material which, on a base, contains at least one photographic element comprising a silver halide-free gelatin layer, which contains a diffusion-resistant bleachable image dye, and a silver halide emulsion layer which is arranged directly on top of the former layer on the side facing the light source and is free of image dye, wherein (a) the gelatin layer containing the image dye has a gelatin/dye ratio of 3:1 to 10:1, (b) the oxidising agent used in the dye and silver bleach is of the formula

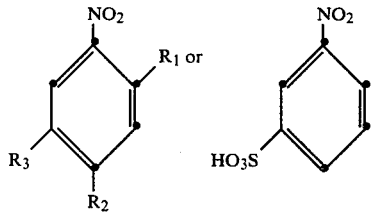

(1) (1b)

in which $R_1$ is hydrogen, alkyl having 1 to 4 carbon atoms, amino or $—SO_3H$, $R_2$ is hydrogen, amino or hydroxyl and $R_3$ is hydrogen, nitro or $—SO_3H$, $R_3$ being other than $—SO_3H$ if $R_1$ and $R_2$ are hydrogen, and (c) the bleach catalyst used in the dye and silver bleach is of the formula

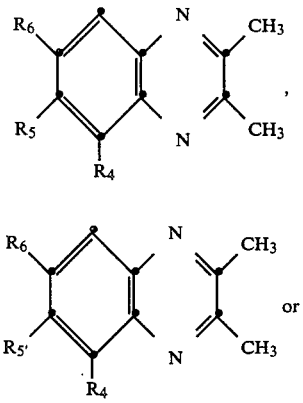

(2a)

(2b)

-continued

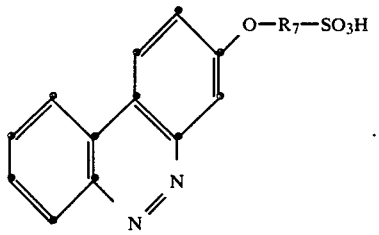

(3)

in which $R_4$ is hydrogen or amino, $R_5$ is hydrogen, hydroxyl, alkyl or alkoxy having 1 to 4 carbon atoms or $—O—R_7—SO_3H$ or $—O—R_7—OH$, $R_5'$ is as defined for $R_5$ with the exception of hydrogen and $—O—R_7—SO_3H$, $R_6$ is hydrogen or alkyl or alkoxy each having 1 to 4 carbon atoms and $R_7$ is alkylene having 1 to 4 carbon atoms, those oxidising agents in which $R_2$ is hydroxyl being used only in conjunction with quinoxalines which are substituted in the 2-, 3-, 6- and 7-positions, those oxidising agents in which $R_2$ is amino being used only in conjunction with quinoxalines which are substituted in at most three of the 2-, 3-, 6- and 7-positions, and the oxidising agent of the formula (1b) being used only in conjunction with bleach catalysts of the formula (2b).

The ring atoms in the quinoxaline skeleton are numbered as follows:

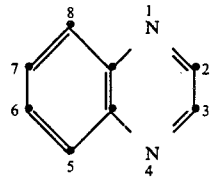

The definition "quinoxaline which is substituted in at most three of the 2-, 3-, 6- and 7-positions", however, also permits substitution in the 5-position and/or 8-position of the quinoxaline skeleton. Analogously, substituents in the 5-position and/or 8-position are permissible also in "quinoxalines which are substituted at least in the 2-, 3-, 6- and 7-positions".

The oxidising agents and bleach catalysts used according to the invention have been disclosed, for example, by U.S. Pat. Nos. 4,145,217, 4,202,698, 3,963,492 and 3,961,957, and they can be prepared by the methods described therein.

The present invention also relates to the images produced by the process according to the invention, and to the dye and silver bleach baths used in the process according to the invention.

The gelatin layer, containing the image dye, on the photographic element in the silver dye bleach material used according to the invention has a gelatin/dye ratio of at most 10:1, preferably from 3:1 to 10:1. However, those ratios are particularly preferred which are between 4:1 and 6:1. These ratios are determined by the given quantity of image dye and the quantity of gelatin derived therefrom. The quantities of the image dye to be used depend on the nature of the dye and the nature of the material (images to be viewed in reflection or images to be viewed in transmission). They are selected in such a way that the three image dyes give a neutral black of the requisite maximum density. For reflection materials, 0.1 to 0.2 $g/m^2$ is required as a rule for this purpose, and 0.4 to 0.6 g/m$^2$ of an image dye is required for transmission material.

Oxidising agents suitable for the processing, according to the invention, of the silver dye bleach material are those of the formula (1), and suitable bleach catalysts are those of the formula (2) and (3). The preferred combinations of oxidising agent and bleach catalyst are:

(I)

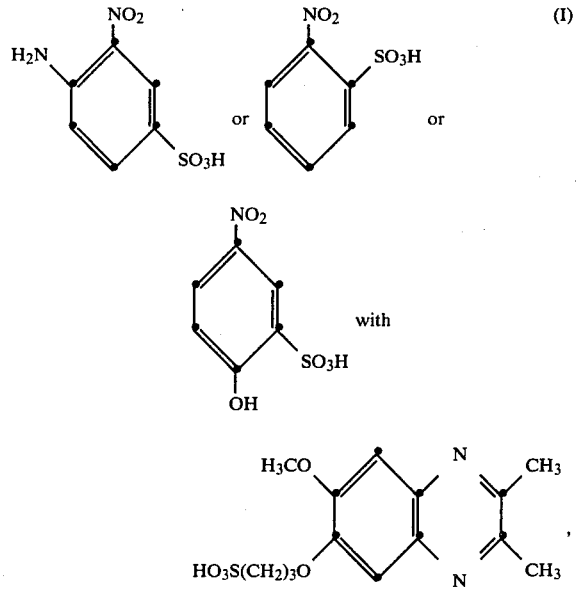

(II)

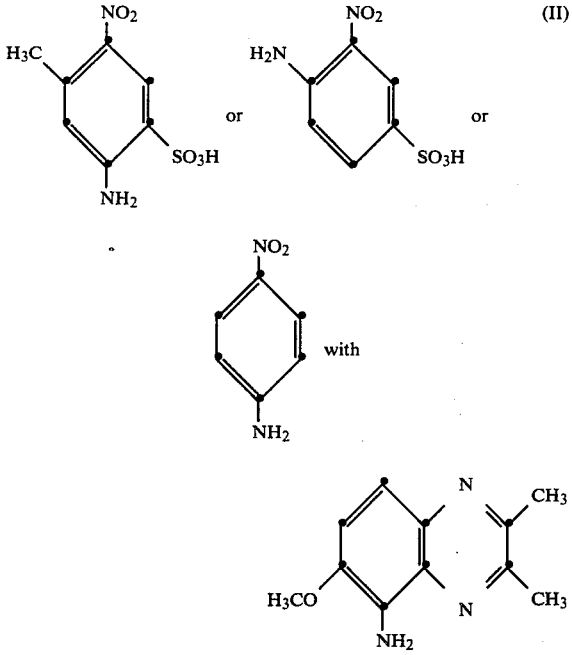

(III)

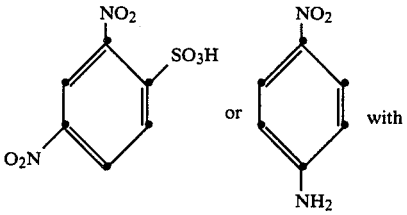

-continued

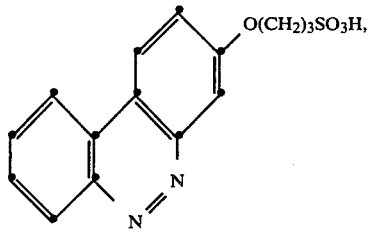

(IV)

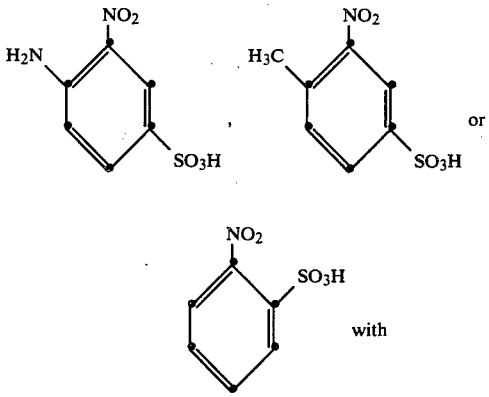

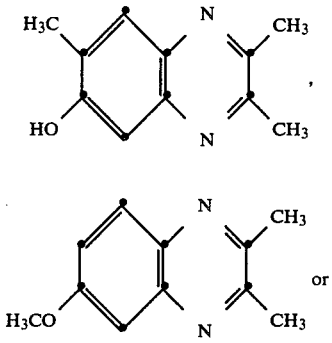

(V)

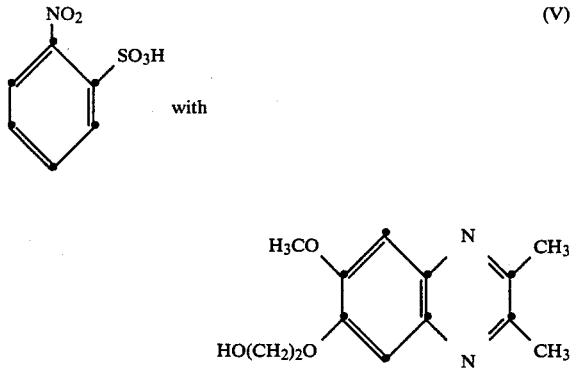

The following are further suitable combinations:

(VI)

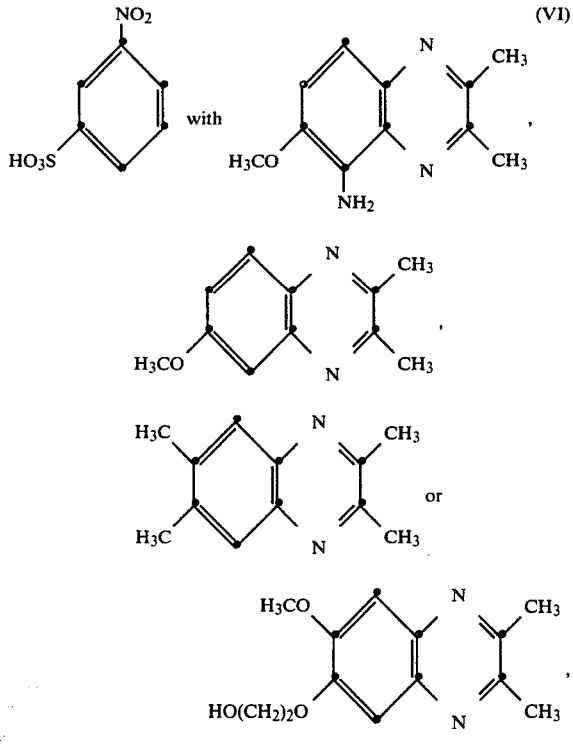

(VII)

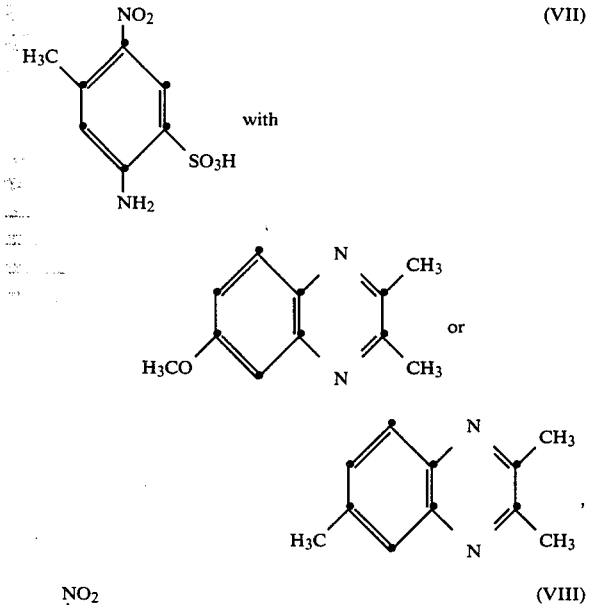

(VIII)

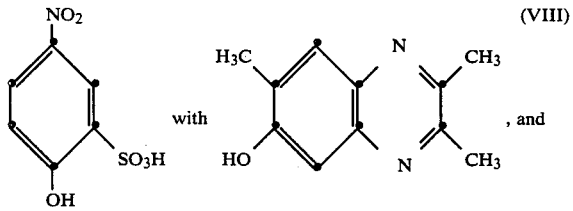

(IX)

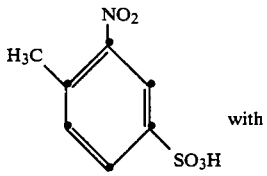

-continued

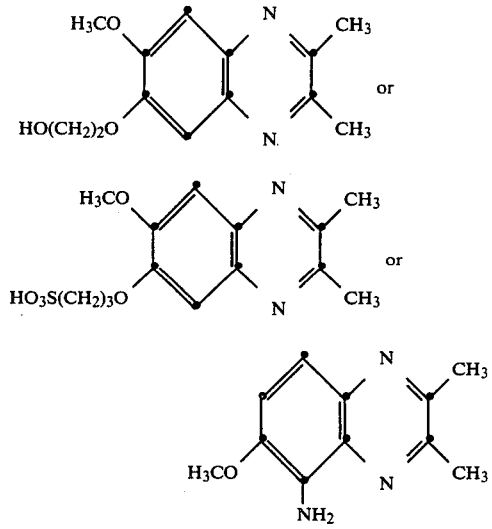

Preferably, the material used according to the invention contains three photographic elements comprising a layer containing silver halide and a layer containing image dye, the latter containing, respectively, a yellow dye, a magenta dye or a cyan dye. If appropriate, the layer containing image dye can contain light-insensitive silver halide which does not contribute to the formation of an image, for example desensitised or very finely dispersed silver halide, in order to enable diffused effects to be achieved. Such image dyes are water-soluble or oil-soluble, diffusion-resistant azo dyes, which are described, for example, in Swiss Patent Specifications Nos. 572,230 and 572,231 and in European Patent Specifications Nos. 39,312, 40,171 and 40,172. To obtain specific speed conditions, however, the photographic material used according to the invention can also contain only one or two of the said photographic elements, whereas the remaining elements consist, for example, of a single layer which contains both image dye and silver halide or, as explained in Swiss Patent Specification No. 526,134, consist of a layer containing image dye and silver halide and of a silver halide emulsion layer arranged on top of the former.

Suitable silver halide emulsions can contain silver bromide or silver iodobromide, and also silver chloride or silver chlorobromide. Such silver halide emulsions are described, for example, in Research Disclosures No. 17.643 (December 1978), No. 18.155 (May 1979) and No. 22.534 (January 1983). The choice of a particular silver halide emulsion is determined primarily by the speed required for the material.

In the material used according to the invention, interlayers are arranged between the individual elements. The thickness of these layers, preferably gelatin layers, is 1.5 to 5 times that of the layer containing the image dye. These interlayers prevent the undesired interaction between the silver image of one element and the layer, containing image dye, of the adjacent element. Particularly effective interlayers contain 1,4-benzoquinones as so-called bleach inhibitors which suppress the diffusion of reduced bleach catalyst from one element into the other. Suitable 1,4-benzoquinones are described in European Patent Specification 117,227. The interlayers can also contain, for example, filter dyes and colloidal silver.

As the base for the material used according to the invention, the customary opaque or transparent materials, for example cellulose triacetate, polyester, polyethylene-coated paper or lacquered paper, or synthetic papers of polystyrene or nylon, can be used.

The gelatin, present in the material used according to the invention, as a binder for the image dye and silver halide and, if appropriate, filter dye and bleach inhibitor can contain additives, such as polyvinyl alcohol or polyvinylpyrrolidone. Moreover, a part of the gelatin can be replaced by dispersions of water-insoluble high-molecular substances, for example dispersion polymers of $\alpha,\beta$-unsaturated compounds, such as acrylic esters, vinyl esters and vinyl ethers, vinyl chloride as well as vinylidene chloride. These additives can also be present in the interlayers described above. Crosslinking of the gelatin is preferably effected with the triazine derivatives described in Swiss Patent Specification No. 574,980.

The exposed material, used according to the invention, is processed by the process steps, customary for silver dye bleach materials, of silver development, dye and silver bleach, fixing and washing, as described accurately and in all details in Swiss Patent Specification No. 584,914.

For the silver development, baths of customary composition can be used, for example those which contain hydroquinone and, if appropriate, additionally, 3-pyrazolidones, for example 1-phenyl-3-pyrazolidone, as the developer substance. It can be an advantage if the developer bath also contains a diazine compound.

The dye and silver bleach is carried out in a bleach bath which contains a strong acid, a water-soluble iodide, an anti-oxidising agent, an oxidising agent of the formula (1) and a bleach catalyst of the formula (2) or (3), preferably in one of the combinations (I) to (VI), and, if appropriate, a bleach accelerator.

The strong acid present in the bleach bath is preferably sulfuric acid or sulfamic acid.

The anti-oxidising agents used are advantageously organic mercapto compounds. It has proved to be particularly advantageous to use the compounds of the formulae $$HS—C_qH_{2q}—B \text{ or} \quad (6)$$

$$HS—(CH_2)_m—COOH \quad (7)$$

in which q is an integer of value 2 to 12, B is a sulfonic or carboxylic acid group and m is one of the numbers 3 and 4. Mercapto compounds which can be used as anti-oxidising agents are described in German Pat. No. 2,258,076. However, the corresponding lactone compounds can also be used as antioxidising agents, as proposed in U.S. Pat. No. 2,961,957. Suitable bleach accelerators are the water-soluble phosphines which are known from German Pat. 2,651,969 and which can at the same time also act as anti-oxidising agents.

The water-soluble iodide used is an alkali metal iodide, preferably potassium iodide.

The pH value of the bleach bath should as a rule be smaller than 2, and this can readily be achieved by the sulfuric acid or sulfamic acid already mentioned. The temperature of the bleach bath, like that of the other treatment baths, is 20° to 90° C. In general it is advantageous not to exceed 60° C. and to work at, for example, 30° to 40° C. However, it is a further advantage of the process that it gives good images of normal colour balance at a higher temperature, for example at 50° C. or even higher. Due to the increase in temperature, the processing can be further shortened, and the baths still remain stable for a sufficiently long time even under these conditions. The quantitative ratios of the components present in the bleach bath can be varied within fairly wide limits and are advantageously selected analogously to those of known methods. It is advantageous when the bleach baths contain the indicated, relatively large quantity of 0.5 to 5 g of dye bleach catalyst per liter of bath fluid. The following quantity ranges for the individual additives should also be mentioned as being advantageous: 5 to 20 g of iodide, 0.1 to 30 g of oxidising agent and 0.5 to 5 g of anti-oxidising agent per liter of bleach bath.

The components of the bleach bath can also be in the form of aqueous or pasty concentrates which give ready-to-use solutions by, for example, 5-fold to 10-fold dilution with water.

The fixing bath can have the known and customary composition. For example, sodium thiosulfate or, with advantage, ammonium thiosulfate, if desired with additions such as sodium bisulfate and/or sodium metabisulfite, is used as the fixer.

A repeat of individual treatments (in each case in a further tank with a bath of the same composition as the preceding bath) within the scope of the given time limit is possible, and an improved bath utilisation can be achieved in some cases by this means. If permitted by the number of the available tanks and by the time programme, water baths can also be inserted between baths having different effects. However, the material is advantageously transferred from the silver development bath directly into the bleach bath, especially if the silver development bath already contains a dye bleach catalyst. All the baths can contain additives, for example hardeners, wetting agents, fluorescent brighteners and/or UV absorbers.

The processes according to the invention can be used, for example, in the production of positive colour images in automatic printing machines or automatic cameras, or in the high-speed processing of other silver dye bleach materials, for example for scientific records and industrial purposes, for example coloured fluororadiography.

The material used according to the invention has, when it is processed as described, a speed of about 50 ISO (as compared with 5 ISO for conventional silver dye bleach materials) and can therefore also be used as a camera film material.

EXAMPLE 1

The following layers are applied, in this order, to a white-opaque base:

1. a layer which contains 0.780 g/m$^2$ of gelatin and 0.148 g/m$^2$ of the cyan dye of the formula

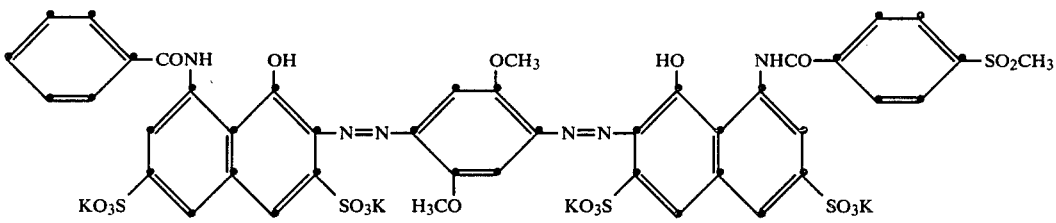

(100)

2. a red-sensitive silver bromoiodide emulsion layer which contains 0.70 g/m$^2$ of gelatin in 0.47 g/m$^2$ of silver as silver bromoiodide;

3. an interlayer of 2.2 g/m$^2$ of gelatin;

4. a layer which contains 0.75 g/m$^2$ of gelatin and 0.145 g/m$^2$ of the magenta dye of the formula

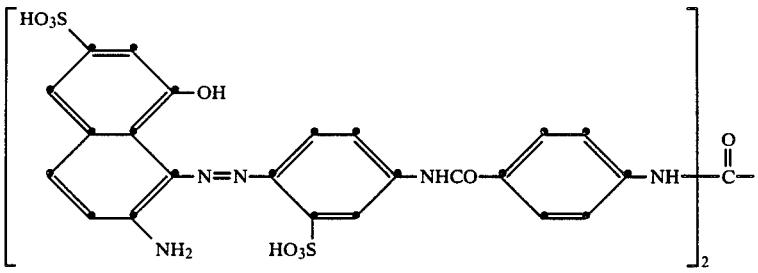

(101)

5. a green-sensitive silver bromoiodide emulsion layer which contains 0.70 g/m$^2$ of gelatin and 0.49 g/m$^2$ of silver as silver bromoiodide;

6. an interlayer or yellow filter layer which contains 2.5 g/m$^2$ of gelatin, 0.030 g/m$^2$ of the yellow dye of the formula

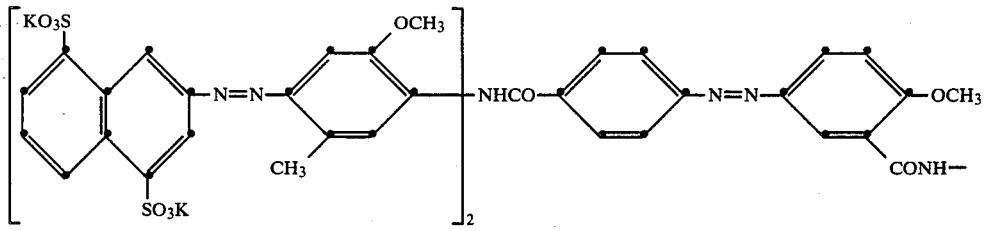

(102)

and 0.016 g/m$^2$ of colloidal silver;

7. a layer which contains 0.800 g/m$^2$ of gelatin and 0.085 g/m$^2$ of the yellow dye of the formula (102);

8. a blue-sensitive silver bomide emulsion layer which contains 0.85 g/m$^2$ of gelatin and 0.30 g/m$^2$ of silver as silver bromide, and 9. a protective layer of 1.2 g/m$^2$ of gelatin.

In addition, the material contains 0.33 g/m$^2$ of 2-amino-4-hydroxy-6-(4-methylmorpholinium)-1,3,5-triazine tetrafluoroborate.

The material is exposed in a camera like a film of 50 ISO speed and is processed as follows:

| | |
|---|---|
| developing | 60 seconds, |
| bleaching | |
| washing | 20 seconds, |
| fixing | 60 seconds |
| washing | |

The temperature of the processing baths is 35° C. in each case.

The baths used have the following composition:

| | |
|---|---|
| Developer bath: | |
| Sodium ethylenediaminetetracetate | 2.0 g |
| Potassium bromide | 2.0 g |
| Ethylcellosolve | 60.0 g |
| Phenidone Z | 3.0 g |
| Hydroquinone | 15.0 g |
| Benzotriazole | 0.8 g |
| Boric acid | 16.0 g |
| Ascorbic acid | 10.0 g |
| Potassium hydroxide | 26.0 g |
| Potassium metabisulfite | 26.0 g |
| Water to make up to | 1000 ml |
| Bleach bath: | |
| Sulfuric acid (100%) | 49 g |
| Sodium 2-nitrobenzenesulfonate | 15 g |
| 6-(2-Hydroxyethoxy)-7-methoxy-2,3-dimethylquinoxaline | 1.25 g |
| 4-Mercaptobutyric acid | 1.70 g |
| Potassium iodide | 10 g |
| Water to make up to | 1000 ml |
| Fixing bath: | |
| Ammonium thiosulfate | 250 g |
| Potassium metabisulfite | 50 g |
| Potassium hydroxide | 20 g |
| N—Methyl-2-pyrrolidone | 100 ml |
| Water to make up to | 1000 ml |

This gives a positive image of the photographed subject with good detail in the highlights and shadows.

Equally good results are obtained when, in place of the bleach bath indicated, a bleach bath of the composition:

| | |
|---|---|
| Sulfuric acid (100%) | 49 g |
| Sodium 3-nitrobenzenesulfonate | 0.5 g |
| 2,3,6-Trimethylquinoxaline | 0.9 g |
| 4-Mercaptobutyric acid | 1.7 g |
| Potassium iodide | 10 g |
| Water to make up to | 1000 ml |
| or of the composition | |
| Sulfuric acid (100%) | 49 g |
| Sodium 3-nitrobenzenesulfonate | 0.5 g |
| 6-Methoxy-2,3-dimethylquinoxaline | 0.9 g |
| 4-Mercaptobutyric acid | 1.7 g |
| Potassium iodide | 10 g |
| Water to make up to | 1000 ml |
| is used. | |

Good results are also obtained when the oxidising agents and bleach catalysts according to the combinations (I) to (IV) and (IX) are used in the bleach bath.

EXAMPLE 2

The following layers are applied, in this order, to a white-opaque base:

1. a layer which contains 1000 g/m$^2$ of gelatin and 0.148 g/m$^2$ of the cyan dye of the formula (100);
2. a red-sensitive silver bromoiodide emulsion layer which contains 0.7 g/m$^2$ of gelatin and 0.47 g/m$^2$ of silver as silver bromoiodide;
3. an interlayer of 2.25 g/m$^2$ of gelatin;
4. a green-sensitive silver bromoiodide emulsion layer which contains 2.5 g/m$^2$ of gelatin, 0.154 g/m$^2$ of the magenta dye of the formula (101) and 0.25 g/m$^2$ of silver as silver bromoiodide;
5. an interlayer or yellow filter layer which contains 1.683 g/m$^2$ of gelatin, 0.027 g/m$^2$ of the yellow dye of the formula (102) and 0.041 g/m$^2$ of colloidal silver;
6. a blue-sensitive silver bromoiodide emulsion layer which contains 1.62 g/m$^2$ of gelatin, 0.088 g/m$^2$ of the yellow dye of the formula (102) and 0.23 g/m$^2$ of silver as silver bromoiodide, and
7. a protective layer of 1.161 g/m$^2$ of gelatin.

In addition, the material contains 0.33 g/m$^2$ of 2-amino-4-hydroxy-6-(4-methylmorpholinium)-1,3,5-triazine tetrafluoroborate.

The material is exposed successively with the red, green and blue light fractions of an electronically produced image by means of a cathode ray tube. It is then processed as indicated in Example 1.

The following exposure times give a copy in the true colours of the video image:

| | |
|---|---|
| red exposure: | 31 seconds |
| green exposure: | 4 seconds |
| blue exposure: | 3 seconds. |

For a comparison, a material is prepared which contains the cyan dye of the formula (100) and the red-sensitive silver bromoiodide emulsion in the same layer. The remaining layers are unchanged.

This material then requires a red exposure of 183 seconds.

EXAMPLE 3

A material is prepared as described in Example 1, with the difference that, in place of the interlayer 3, a layer of 1 g of gelatin and 0.3 g of a fine dispersion of a bleach inhibitor of the formula

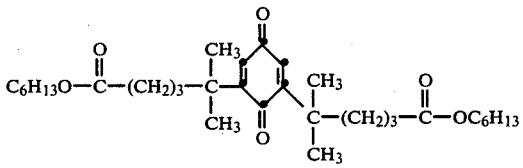

(103)

is applied.

The material is exposed and processed as indicated in Example 1, and a positive image of the photographed subject is obtained, without any bleach coupling between the red-sensitive silver halide layer and the layer containing the magenta dye. This means that red colour shades can be reproduced with high colour saturation.

I claim:

1. A process for the production of photographic images by the silver dye bleach process by exposure, development, dye and silver bleach, and fixing of a photographic material which, on a base, contains at least one photographic element comprising a silver halide-free gelatin layer, which contains a diffusion-resistant bleachable image dye, and a silver halide emulsion layer which is arranged directly on top of the former layer on the side facing the light source and is free of image dye, wherein (a) the gelatin layer containing the image dye has a gelatin/dye ratio of at most 10:1, (b) the oxidising agent used in the dye and silver bleach is of the formula

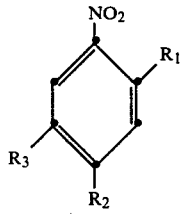

(1)

or

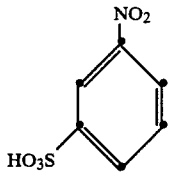

(1b)

in which $R_1$ is hydrogen, alkyl having 1 to 4 carbon atoms, amino or —$SO_3H$, $R_2$ is hydrogen, amino or hydroxyl and $R_3$ is hydrogen, nitro or —$SO_3H$, $R_3$ being other than —$SO_3H$ if $R_1$ and $R_2$ are hydrogen, and (c) the bleach catalyst used in the dye and silver bleach is of the formula (2a)

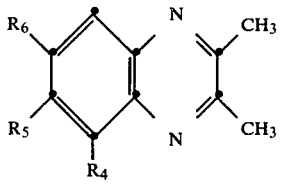

(2b)

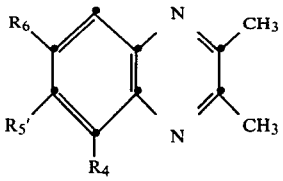

or (3)

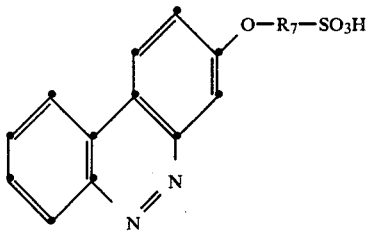

in which $R_4$ is hydrogen or amino, $R_5$ is hydrogen, hydroxyl, alkyl or alkoxy having 1 to 4 carbon atoms or —O—$R_7$—$SO_3H$ or —O—$R_7$—OH, $R_5'$ is as defined for $R_5$ with the exception of hydrogen and —O—$R_7$—$SO_3H$, and $R_5'$ is not methyl or methoxy if $R_4$ and $R_6$ are hydrogen, $R_6$ is hydrogen or alkyl or alkoxy each having 1 to 4 carbon atoms and $R_7$ is alkylene having 1 to 4 carbon atoms, those oxidising agents in which $R_2$ is hydroxyl being used only in conjunction with at least tetrasubstituted quinoxalines, those oxidising agents in which $R_2$ is amino being used only in conjunction with at most trisubstituted quinoxalines, and the oxidising agent of the formula (1b) being used only with bleach catalysts of the formula (2b).

2. A process for the production of photographic images by the silver dye bleach process by exposure, development, dye and silver bleach, and fixing of a photographic material which, on a base, contains at least one photographic element comprising a silver halide-free gelatin layer, which contains a diffusion-resistant bleachable image dye, and a silver halide emulsion layer which is arranged directly on top of the former layer on the side facing the light source and is free of image dye, wherein (a) the gelatin layer containing the image dye has a gelatin/dye ratio of 3:1 to 10:1, (b) the oxidising agent used in the dye and silver bleach is of the formula (1)

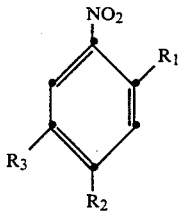

or

-continued (1b)

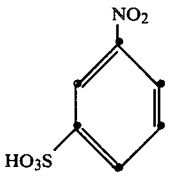

in which $R_1$ is hydrogen, alkyl having 1 to 4 carbon atoms, amino or —$SO_3H$, $R_2$ is hydrogen, amino or hydroxyl and $R_3$ is hydrogen, nitro or —$SO_3H$, $R_3$ being other than —$SO_2H$ if $R_1$ and $R_2$ are hydrogen, and (c) the bleach catalyst used in the dye and silver bleach is of the formula (2a)

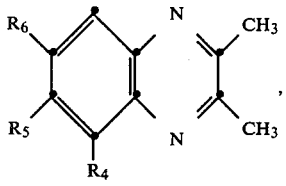

(2b)

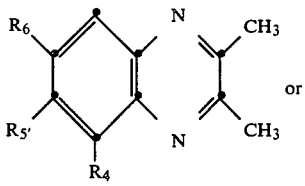

(3)

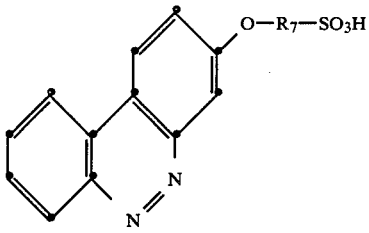

in which $R_4$ is hydrogen or amino, $R_5$ is hydrogen, hydroxyl, alkyl or alkoxy having 1 to 4 carbon atoms or —O—$R_7$—$SO_3H$ or —O—$R_7$—OH, $R_5'$ is as defined for $R_5$ with the exception of hydrogen and —O—$R_7$—$SO_3H$, $R_6$ is hydrogen or alkyl or alkoxy each having 1 to 4 carbon atoms and $R_7$ is alkylene having 1 to 4 carbon atoms, those oxidising agents in which $R_2$ is hydroxyl being used only in conjunction with quinoxalines which are substituted in the 2-, 3-, 6- and 7-positions, those oxidising agents in which $R_2$ is amino being used only in conjunction with quinoxalines which are substituted in at most three of the 2-, 3-, 6- and 7-positions, and the oxidising agent of the formula (1b) being used only in conjunction with bleach catalysts of the formula (2b).

3. A process according to either claim 1 or claim 2, wherein the gelatin/dye ratio in the layer containing the image dye is (4–6):1.

4. A process as claimed in either claim 1 or claim 2, wherein the combinations (I)
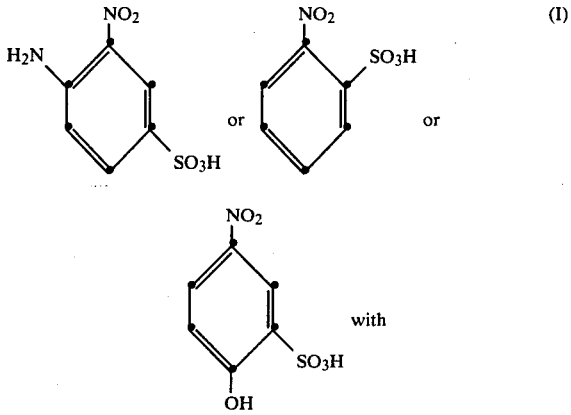
(II)
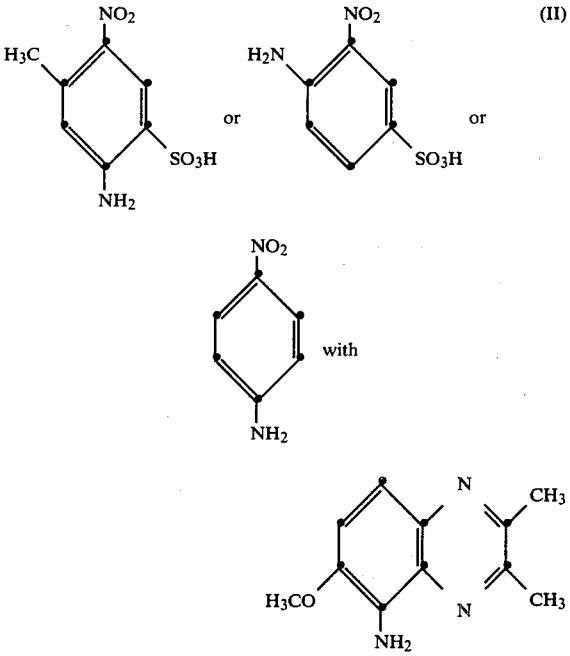
(III)
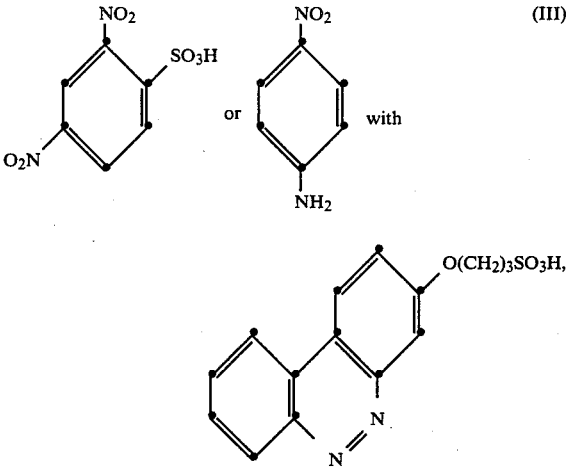
-continued
(IV)
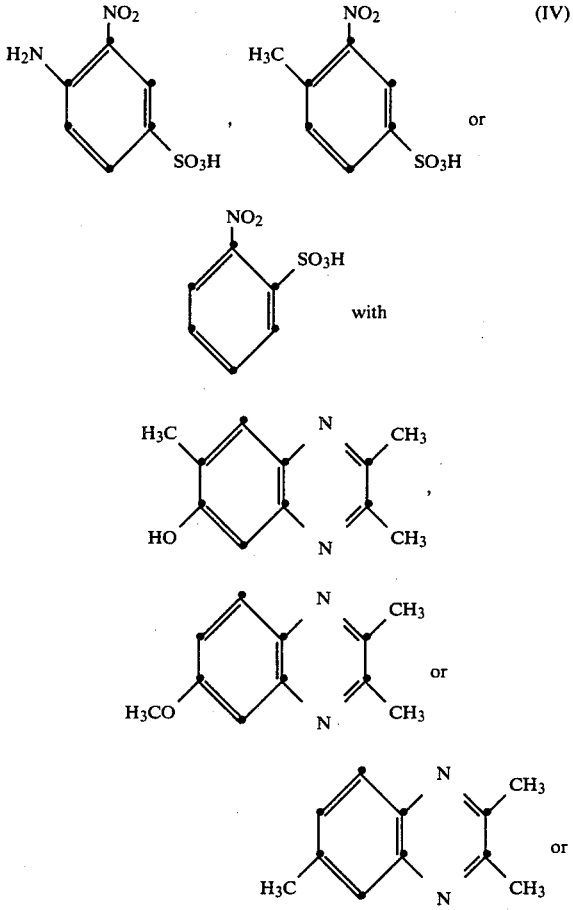
(V)
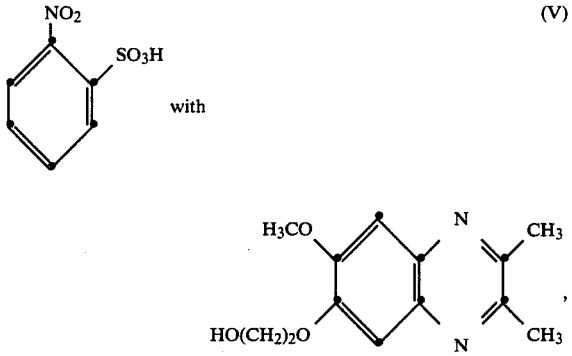
(VI)
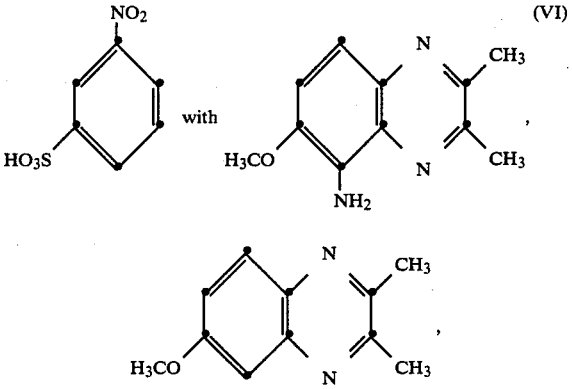

-continued

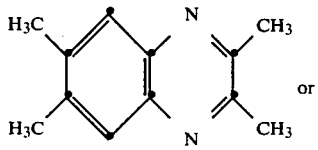

or

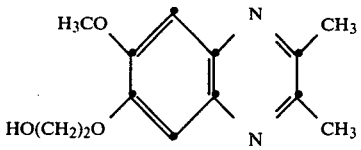

(VII)

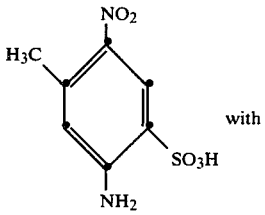

with

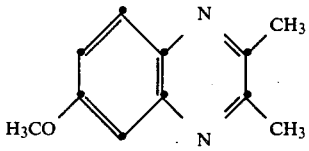

or

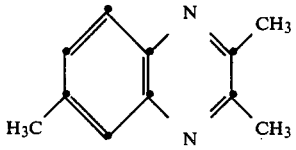

(VIII)

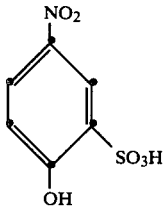

with

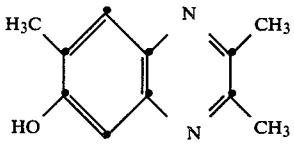

-continued (IX)

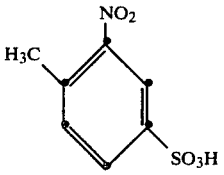

with

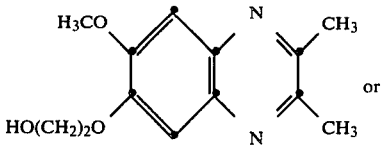

or

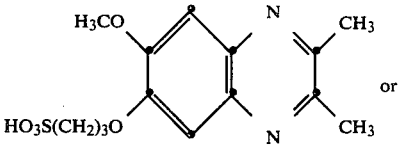

or

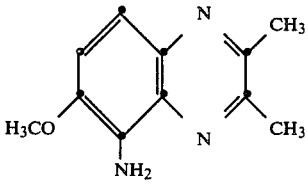

are used as the oxidising agent and bleach catalyst.

5. A process according to either claim 1 or claim 2, wherein the photographic material contains three photographic elements respectively containing a yellow dye, a magenta dye and a cyan dye.

6. A process according to claim 5, wherein interlayers are arranged between the photographic elements.

7. A process according to claim 6, wherein the interlayers contain a bleach inhibitor.

8. A process according to claim 6, wherein the thickness of the interlayers is 1.5 to 5 times that of the layer containing the image dye.

9. A dye and silver bleach preparation for use in the process according to either claim 1 or claim 2, which comprises an oxidising agent of the formula (1a) and a bleach catalyst of the formula (2a) or (3), or an oxidising agent of the formula (1b) and a bleach catalyst of the formula (2b).

* * * * *